US010136473B2

(12) United States Patent
Driussi et al.

(10) Patent No.: US 10,136,473 B2
(45) Date of Patent: Nov. 20, 2018

(54) HEATING CIRCUIT WITH MONITORING ARRANGEMENT FOR A HOUSEHOLD APPLIANCE

(75) Inventors: Paolo Driussi, Porcia (IT); Marco Lorenzi, Porcia (IT)

(73) Assignee: Electrolux Home Products Corporation N.V., Brussels (BE)

( * ) Notice: Subject to any disclaimer, the term of this patent is extended or adjusted under 35 U.S.C. 154(b) by 1482 days.

(21) Appl. No.: 13/697,835

(22) PCT Filed: Apr. 26, 2011

(86) PCT No.: PCT/EP2011/056531

§ 371 (c)(1),
(2), (4) Date: Jan. 3, 2013

(87) PCT Pub. No.: WO2011/141290

PCT Pub. Date: Nov. 17, 2011

(65) Prior Publication Data

US 2013/0119047 A1 May 16, 2013

(30) Foreign Application Priority Data

May 14, 2010 (EP) ..... 10162839

(51) Int. Cl.
*H05B 3/42* (2006.01)
*H05B 3/48* (2006.01)
(Continued)

(52) U.S. Cl.
CPC ..... *H05B 3/02* (2013.01); *D06F 33/02* (2013.01); *D06F 39/04* (2013.01); *D06F 2058/289* (2013.01)

(58) Field of Classification Search
CPC ..... H05B 1/0266; F24C 15/106; H01H 37/10
(Continued)

(56) References Cited

U.S. PATENT DOCUMENTS 2,851,790 A 9/1958 Worst
3,112,187 A * 11/1963 Stone ..... D06F 58/28 34/527
(Continued)

FOREIGN PATENT DOCUMENTS

EP 0 924 331 6/1999
EP 1 744 248 1/2007
(Continued)

OTHER PUBLICATIONS

International Search Report issued in corresponding International Application No. PCT/EP2011/056531, dated Sep. 9, 2011.
(Continued)

*Primary Examiner* — Tu B Hoang
*Assistant Examiner* — Thomas Ward
(74) *Attorney, Agent, or Firm* — Banner & Witcoff, Ltd.

(57) ABSTRACT

A washing and/or drying appliance includes a heating circuit (140) for heating a washing liquid and/or a drying air flow. The heating circuit is connected to voltage distribution lines (105*a*,105*b*) distributing power inside the appliance and includes at least one heating resistor (205) in series to switch means (210*a*,210*b*) controlled by an appliance control unit (125) for selectively energizing the heating resistor when required. The switch means of the heating circuit includes first and second switches (210*a*,210*b*) in series to the heating resistor, the heating resistor being interposed between the first and second switch. A monitoring circuit arrangement is associated with the heating circuit. The monitoring circuit arrangement includes a resistive network including a first resistor (R1) connected to the heating circuit so as to be bypassed when the first switch is closed, the heating resistor, and a second resistor (R2) connected to the heating circuit so as to be bypassed when the second switch is closed. The monitoring circuit arrangement further includes a current
(Continued)

sensor (240) arranged to measure a current flowing through the resistive network and to feed an indication of the measured current to the control unit. The monitoring unit is configured for assessing possible faults of the heating circuit based on the indication of the measured current.

19 Claims, 8 Drawing Sheets

(51) Int. Cl.

| | |
|---|---|
| ***H05B 3/02*** | (2006.01) |
| ***D06F 33/02*** | (2006.01) |
| ***D06F 39/04*** | (2006.01) |
| *D06F 58/28* | (2006.01) |

(58) Field of Classification Search
USPC ..... 34/553, 527, 493, 507, 528; 392/466, 392/486; 37/141, 183; 219/507, 509
See application file for complete search history.

(56) References Cited

U.S. PATENT DOCUMENTS

| | | | | |
|---|---|---|---|---|
| 3,180,038 | A * | 4/1965 | Chafee, Jr. | D06F 58/28 34/533 |
| 3,266,167 | A * | 8/1966 | Finnegan | D06F 58/28 33/41.1 |
| 3,409,994 | A | 11/1968 | Menk | |
| 3,417,480 | A * | 12/1968 | Thunander | D06F 58/28 34/528 |
| 3,475,830 | A | 11/1969 | Botts et al. | |
| 3,609,873 | A | 10/1971 | Odle, Jr. et al. | |
| 3,942,265 | A | 3/1976 | Sisler et al. | |
| 4,019,259 | A | 4/1977 | Veraart | |
| 4,083,118 | A | 4/1978 | Cotton | |
| 4,208,890 | A | 6/1980 | Wood | |
| 4,642,907 | A | 2/1987 | Best | |
| 5,564,831 | A | 10/1996 | Bashark | |
| 6,064,043 | A | 5/2000 | Livers, Jr. et al. | |
| 6,079,121 | A | 6/2000 | Khadkikar et al. | |
| 6,246,831 | B1 | 6/2001 | Seitz et al. | |
| 7,594,343 | B2 | 9/2009 | Woerdehoff et al. | |
| 8,015,726 | B2 | 9/2011 | Carow et al. | |
| 2009/0064722 | A1 * | 3/2009 | Lee | D06F 37/304 68/12.16 |
| 2013/0061488 | A1 | 3/2013 | Lorenzi et al. | |
| 2013/0119047 | A1 | 5/2013 | Driussi et al. | |
| 2013/0126517 | A1 | 5/2013 | Driussi et al. | |

FOREIGN PATENT DOCUMENTS

| | | |
|---|---|---|
| EP | 2 085 836 | 8/2009 |
| JP | 09 024197 | 1/1997 |

OTHER PUBLICATIONS

European Search Report issued in corresponding European Application No. 10162839.4 dated Nov. 17, 2010.
International Search Report dated Aug. 19, 2011 in International Application No. PCT/EP2011/05674 corresponding to related U.S. Appl. No. 13/697,832.
Italian Search Report and Opinion dated Jan. 26, 2011 in Italian Application No. MI2010A000862 corresponding to related U.S. Appl. No. 13/697,832.
International Search Report dated Sep. 13, 2011 in International Application No. PCT/EP2011/0057712 corresponding to related U.S. Appl. No. 13/697,838.
European Search Report dated Nov. 9, 2010 in European Application No. 10162838.6 corresponding to related U.S. Appl. No. 13/697,838.
Jun. 30, 2014—U.S. Notice of Allowance—U.S. Appl. No. 13/697,838.
Apr. 24, 2015—U.S. Non Final Rejection—U.S. Appl. No. 13/697,832.
Oct. 30, 2015—U.S. Final Rejection—U.S. Appl. No. 13/697,832.
Aug. 23, 2016—U.S. Office Action—U.S. Appl. No. 13/697,832.
Mar. 10, 2017—U.S. Office Action—U.S. Appl. No. 13/697,832.
Oct. 20, 2016—U.S. Final Rejection—U.S. Appl. No. 13/697,835.

* cited by examiner

HEATING CIRCUIT WITH MONITORING ARRANGEMENT FOR A HOUSEHOLD APPLIANCE

BACKGROUND OF THE INVENTION

The present invention relates in general to the field of household appliances, and more particularly to a heating circuit with monitoring arrangement for appliances like laundry washers, combined washers&dryers, dryers, dishwashers and the like, and in general for all those appliances wherein there is the necessity of heating a fluid (a washing liquid like in laundry washing machines or in dishwashers, or drying air like in laundry dryers).

Heating circuits for household appliances like those listed above generally comprise a fluid heating element, consisting of a heating resistor, and a switch element (e.g. a relay commanded by an appliance control unit, or a level switch which closes only when a sufficient amount of liquid is present in the washing tub to ensure that the heating resistor is fully immersed) for selectively energizing the heating resistor when required, for example in order to heat the washing liquid for washing laundry or dishes, or to heat the air flow used to dry the laundry.

The heating circuit is generally monitored for assessing the proper operation and detecting possible faults thereof. Faults may as a matter of fact occur in the heating resistor or in the switch element energizing it. The heating circuit should be monitored to identify whether the heating resistor is powered on or off, or if it is short-circuited to earth. Some of these faults may be extremely dangerous, for the appliance and even more for the user's health. For example, overheating of the heating resistor should be prevented, not to cause component parts to be damaged or destroyed, and fires to be produced; also, a heating resistor that happens to be short-circuited to earth is a source of danger, because dispersion currents may reach the appliance cabinet and cause electrical shocks to the user when touching it. In case a fault of this type is detected, a decision is to be taken to halt the appliance.

The Applicant has observed that known monitoring arrangements of the heating circuit are not capable of discriminating among all the possible different types of faults the heating circuit may suffer. The impossibility of discriminating the nature of the fault leads to classifying some faults as dangerous for the user's safety and thus lead to the appliance halt even if, actually, there would be no risk and the machine operation could be continued. This is undesirable, because the user has to wait for the intervention of the service personnel even if, in principle, the machine could continue to operate, although with lower performance.

The Applicant has also observed that some of the known solutions for monitoring the heating circuit cause power consumption even when the appliance is not operated (i.e., it is off). Also this is undesired, especially nowadays that the power consumption of household appliances is a major quality factor.

SUMMARY OF SELECTED INVENTIVE ASPECTS

In view of the state of the art outlined above, it has been an object of the present invention to devise an improved heating circuit arrangement for a household appliance that guarantees a full monitoring and discrimination of essentially every possible fault thereof, and at the same time does not cause unnecessary power consumption.

According to an aspect of the present invention, there is provided a washing and/or drying appliance, comprising a heating circuit for heating a washing liquid and/or a drying air flow, the heating circuit being connected to (AC) voltage distribution lines distributing (AC) power inside the appliance and comprising at least one heating resistor in series to switch means controlled by an appliance control unit for selectively energizing the heating resistor when required.

The switch means of the heating circuit comprise a first and a second switches in series to the heating resistor, the heating resistor being interposed between the first and second switch.

A monitoring circuit arrangement is associated with the heating circuit, said monitoring circuit arrangement comprising a resistive network including a first resistor connected to the heating circuit so as to be bypassed when the first switch is closed, the heating resistor, and a second resistor connected to the heating circuit so as to be bypassed when the second switch is closed.

The monitoring circuit arrangement further comprises a current sensor arranged to measure a current flowing through the resistive network and to feed an indication of the measured current to the control unit.

The monitoring unit is configured for assessing possible faults of the heating circuit based on the indication of the measured current.

The appliance may further comprise a main switch controlled by the control unit for selectively allowing the powering of the appliance; the heating circuit may be connected to the voltage supply lines upstream or downstream the main switch with respect to an AC voltage plug of the appliance.

The main switch may be a switch switchable to close only conditioned to the fact that the control unit detects that an appliance door is closed.

The resistive network of the monitoring circuit arrangement may be connected to the voltage distribution lines either downstream or upstream the main switch.

The resistive network may further comprise a third resistor connected in shunt to the heating resistor and having a resistance value substantially higher than the heating resistor resistance value.

The current sensor may comprise a resistor in series to the first and/or second resistors. Alternatively, the current sensor may comprise one among an amperometric transformer or a Hall sensor.

The first resistor may have a first terminal coupled to a first one of the voltage distribution lines and a second terminal connected to a first terminal of the heating resistor which is coupled to said first one of the voltage distribution lines, and the second resistor may have a first terminal connected to a second terminal of the heating resistor opposite the first heating resistor terminal and a second terminal coupled to a second one of the voltage distribution lines.

Alternatively, the first resistor may have a first terminal coupled to a first one of the voltage distribution lines and a second terminal connected to a second terminal of the heating resistor which is coupled to a second one of the voltage distribution lines, and the second resistor may have a first terminal connected to a first terminal of the heating resistor which is coupled to the first voltage distribution lines and a second terminal coupled to the second voltage distribution line.

BRIEF DESCRIPTION OF THE DRAWINGS

These and other features and advantages of the present invention will appear more clearly by reading the following detailed description of some embodiments thereof, provided merely by way of non-limiting example, description that will be conducted making reference, for better intelligibility, to the attached drawings, wherein.

DETAILED DESCRIPTION OF EXAMPLE EMBODIMENTS

Figure 1:
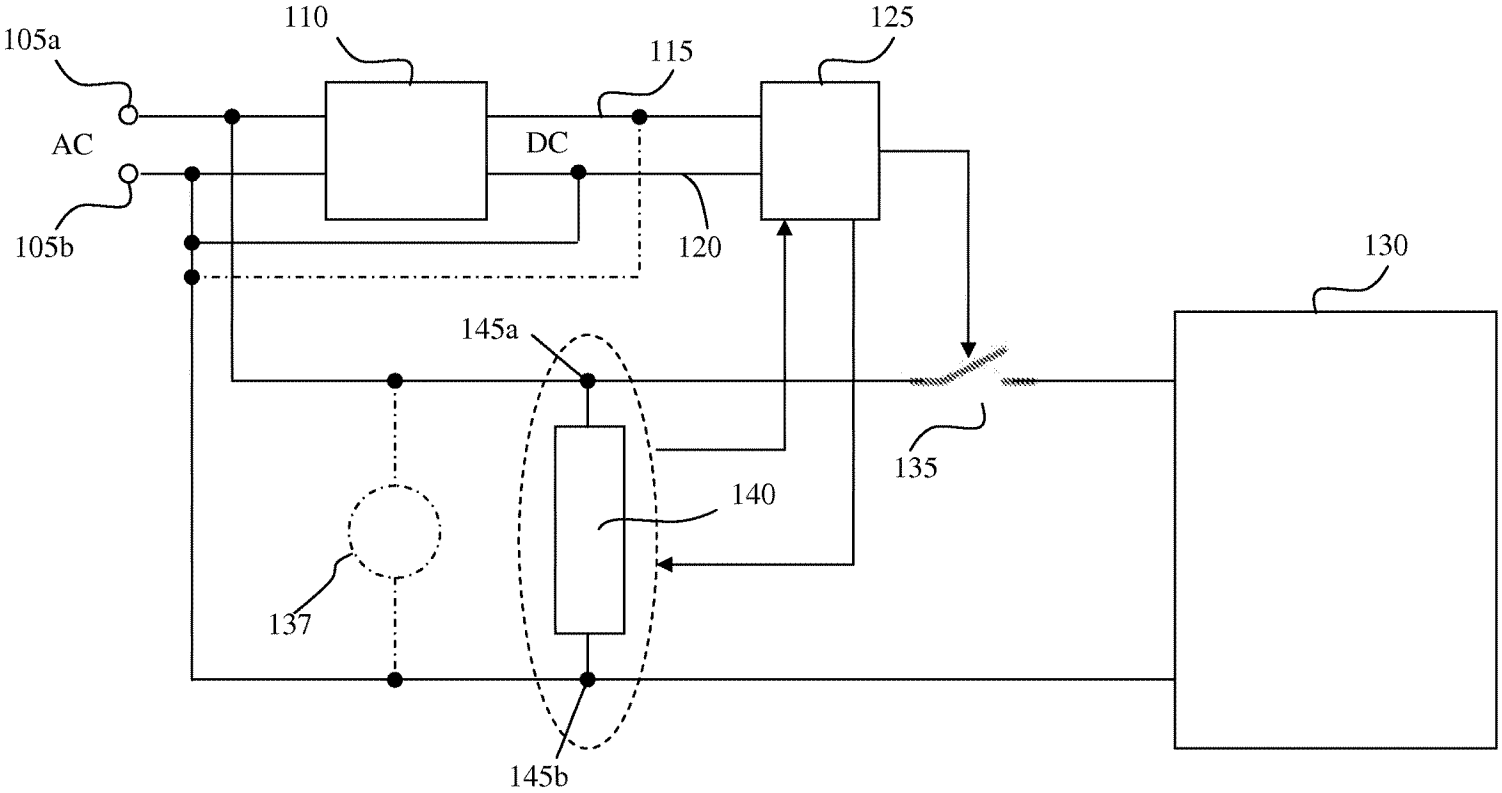
FIG. 1 is a schematic block diagram of part of an electric circuitry of a household appliance, for example a laundry washer, with a heating circuit arrangement according to an embodiment of the present invention.

Making reference to the drawings, FIG. 1 depicts a schematic block diagram of part of an electric circuitry of a household appliance, for example, but not limitatively, a laundry washer. Reference numerals 105*a* and 105*b* denote two terminals which, in use, are plugged into an electricity main socket (not shown), for receiving the AC voltage (for example, terminal 105*a* is connected to a plug pin that is plugged to the AC socket port of the line voltage, and terminal 105*b* is connected to a plug pin that is plugged to the AC socket port of the neutral); the AC voltage may for example be of 220V at 50 Hz nominal, or of 110V at 60 Hz nominal (other values are possible, depending on the standard adopted in a particular country).

The AC voltage is fed to a voltage transformer and rectifying circuit arrangement 110, for generating one or more DC voltage values, distributed by DC voltage distribution lines 115 and 120, for example a 5V voltage for supplying a logic control unit 125, including for example a microprocessor or a microcontroller, programmed for controlling the operation of the appliance. Either one or the other of the DC voltage distribution lines 115 and 120 may be connected to the neutral (terminal 105*b*).

Block 130 is intended to schematically represent all those parts of the appliance that are supplied by the AC voltage; such parts include for example the electric motor for rotating the laundry drum, the drain pump for discharging the washing/rinsing fluid, and the electrovalve(s) for intaking water from a water main. The AC line voltage received at the terminal 105*a* is selectively fed to the parts schematized by block 130 through a machine main switch 135 (which may for example be the so-called "door-lock" switch), controlled by the control unit 125, which can be switched to close only on condition that the control unit 125 detects that the appliance door (not depicted in the drawings) is correctly closed. In this way, it is ensured that, for safety purposes, the appliance cannot be started or is halted when the door is open, so as to prevent possible injuries. In alternative embodiments of the invention, some of the parts schematized as included in block 130 downstream the main switch 135 may be moved upstream of it; this may for example be the case of the drain pump 137, shown in phantom in FIG. 1, which, when placed upstream the main switch 135, can be operated for safety purposes to discharge the liquid present in the machine even in case the door is open.

Reference numeral 140 denotes a heating circuit with monitoring arrangement, provided in the appliance for heating the washing liquid for washing and/or rinse laundry. According to an embodiment of the present invention, the heating circuit 140 is connected to the AC voltage terminals 105*a*, 105*b* upstream the main switch 135, i.e. one terminal 145*a* of the heating circuit 140 is connected to a conductor connected to the terminal 105*a* and carrying the line voltage, and the other terminal 145*b* is connected to the neutral terminal 105*b*.

The operation of the heating circuit 140 is controlled by the control unit 125, which in addition monitors (through the monitoring arrangement) the heating circuit 140 for detecting possible faults thereof, as will be described in greater detail in the following.

Figure 2:
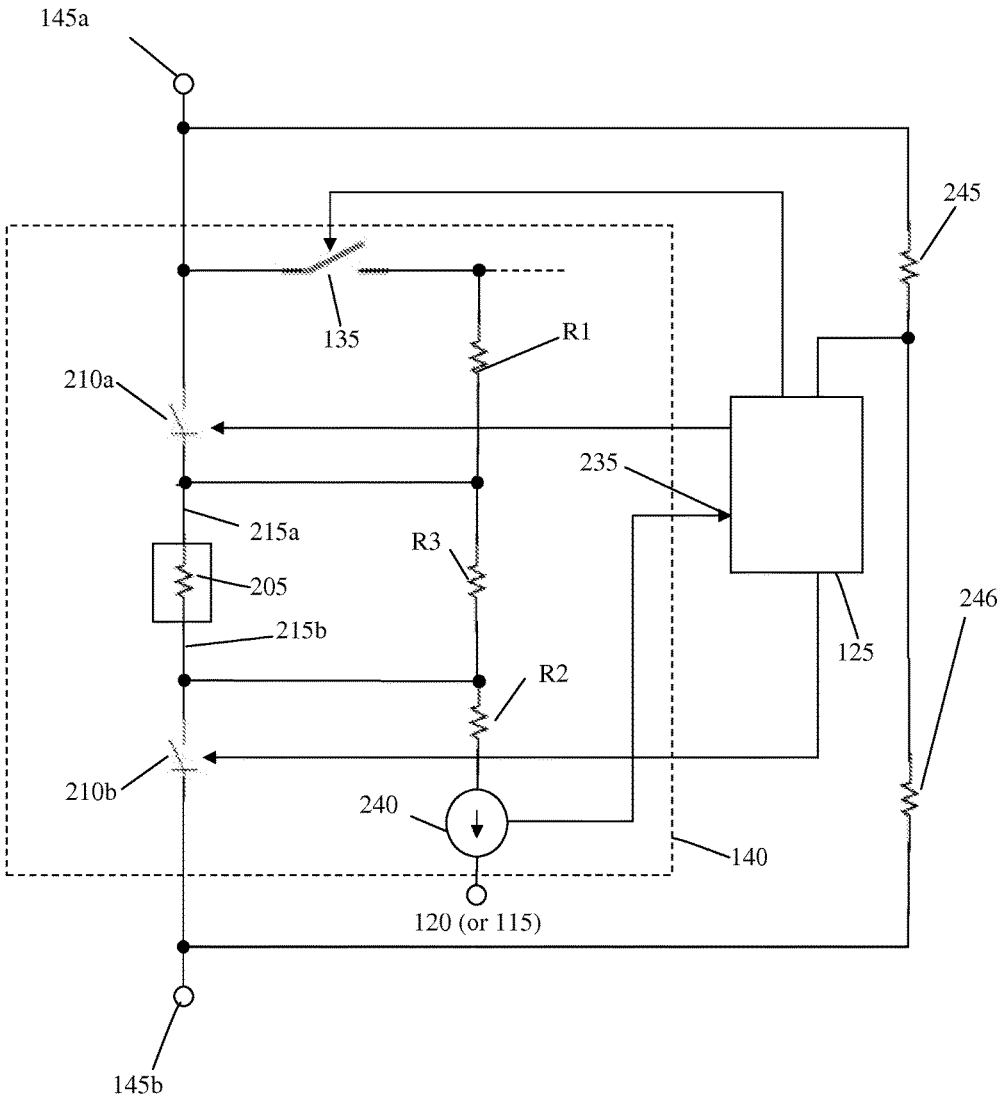
FIG. 2 shows in greater detail the heating circuit arrangement of FIG. 1, in an embodiment of the present invention.

FIG. 2 depicts in detail the schematic of the heating circuit 140 according to an embodiment of the present invention. The heating circuit 140 of the exemplary embodiment here considered comprises at least one heating resistor 205, connected in series with two switches 210*a* and 210*b*, namely a high-side switch 210*a* and a low-side switch 210*b*, between the voltage line connected to the line voltage terminal 105*a* and, respectively, the neutral line connected to the neutral terminal 105*b*. The heating resistor 205 is the element that, when energized, heats the washing liquid and/or the drying air flow. The switches 210*a* and 210*b* are for example relays, particularly monostable relays or alternatively bistable relays, which are controlled, similarly to the main switch 135, by the control unit 125. One or two thermofuses may be provided at either one or both of the two terminals 215*a* and 215*b* of the heating resistor 205, for protecting the heating resistor 205 against burning in case of overheating (in such a case, one or both of the thermofuses blow and thereby disconnect the heating resistor from the heating circuit); however, as will be clear from the following, the provision of the thermofuses is not strictly necessary, because thanks to the arrangement described the heating circuit and particularly the heating resistor are fully protected even without thermofuses.

It is clear from FIG. 2 that the heating resistor 205 is interposed between the two switches 210*a* and 210*b* with a first node on a high side of heating resistor 205 in electrical contact with a low side terminal of switch 210*a*, and a second node on a low side of heating resistor 205 in electrical contact with a high side terminal of switch 210*b*.

The monitoring arrangement of the heating circuit comprises a resistive network defining a monitoring current path. The resistive network comprises a series connection of:

a first resistor R1, connected between the voltage line, preferably downstream of the main switch 135 and the terminal 215*a* of the heating resistor 205 which is connected to the switch 210*a;* the heating resistor 205; and a second resistor R2 connected between the terminal 215*b* of the heating resistor 205 connected to the switch 210*b* and a first terminal of a current sensor 240 whose second terminal is connected to one of the DC voltage distribution lines 120 or 115, particularly to the DC voltage distribution line that is connected to the neutral). The current sensor 240 is adapted to measure the current flowing therethrough, and to provide an indication of the measured current to a measuring input 235 of the control unit 125.

Preferably, a third resistor R3 may be provided in the resistive network, connected in shunt between the terminals 215*a* and 215*b* of the heating resistor 205.

The first resistor R1 may have a resistance value of the order of some hundreds of KOhms, for example 600-700

KOhms; the resistance of the second resistor R2 may be as well of a few hundreds of KOhms, for example 100-200 KOhms. Typical resistance values of the heating resistor 205 are of few tens of Ohms, e.g. approximately 30 Ohms. The third resistor R3 (when provided) has a resistance value substantially higher than the typical resistance of the heating resistor 205, for example 100-200 KOhms: thus, when the heating resistor 205 functions properly, the overall resistance of the shunt connection between the third resistor R3 and the heating resistor 205 essentially coincides with the resistance of the heating resistor 205). The provision of the third resistor R3 allows discriminating some faults of the heating circuit, as discussed in the following.

Figure 7:
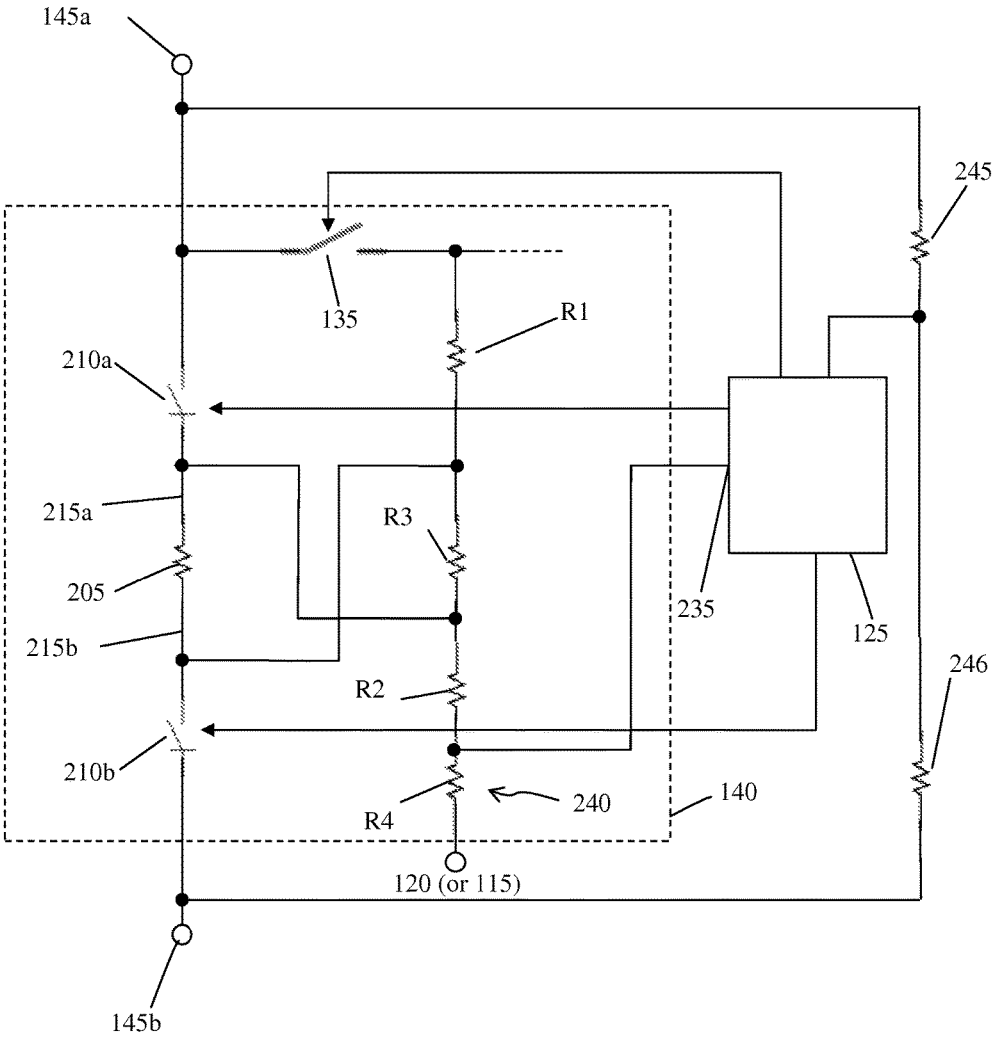
FIG. 7 schematically shows the heating circuit arrangement of FIG. 1 according to a variant of the embodiment of FIG. 2.
Figure 8:
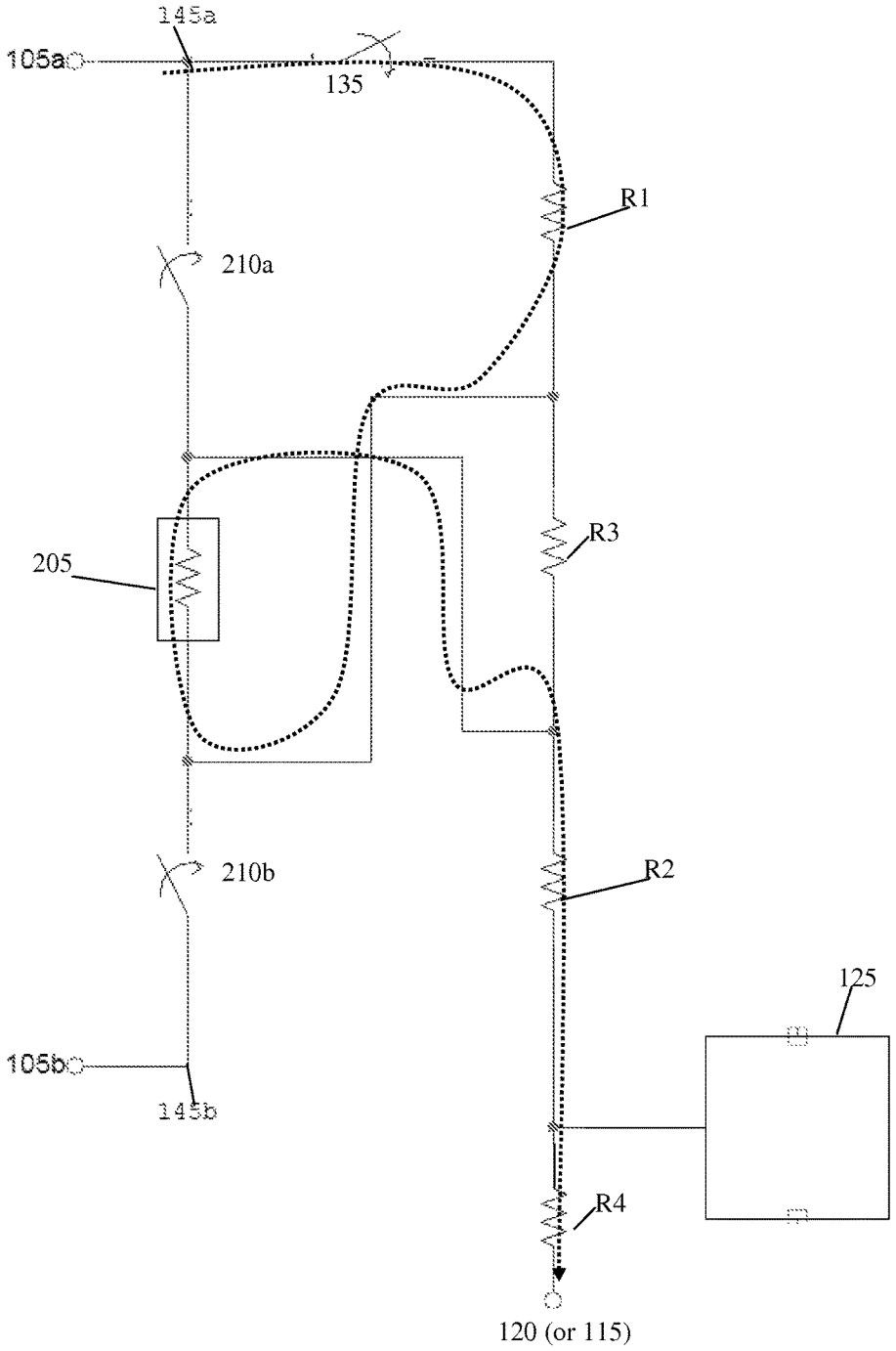
FIG. 8 schematically shows a current path in an operating condition of the heating circuit arrangement of FIG. 7.

The current sensor 240 may for example be implemented as a fourth resistor R4, as depicted in FIGS. 7 and 8, which provides a measure of the current flowing therethrough in terms of a voltage developing thereacross; in this case, the measuring input 235 of the control unit 125 is coupled or connected to the common terminal between the second resistor R2 and the fourth resistor R4. The resistance of the fourth resistor implementing the current sensor is preferably negligible compared to the resistance of the second resistor R2, for example it may be of the order of a few KOhms.

The control unit 125 is further arranged to sense the line voltage received at terminal 105*a*, for example through a resistive voltage partition network which may include one or two resistors 245, 246 connected between the line voltage and the neutral.

The heating circuit and related monitored arrangement 140 of FIG. 2 operate as follows.

When the appliance is plugged into the main voltage socket, the control unit 125 is energized.

When the user inputs an appliance start command, conditioned to the fact that the door is assessed to be closed, the control unit commands the main switch 135 to close, thereby energizing the machine parts schematized in block 130.

In order to heat the washing fluid and/or the drying air flow, the control unit 125 commands the switches 210*a* and 210*b* to close. In this way, the heating resistor 205 is energized. Also in this case, the control unit 125 commands the switches 210*a* and 210*b* to close only conditioned to the fact that the appliance door is assessed to be closed.

The control unit 125, thanks to the circuit arrangement shown, is able to monitor the correct operation of the heating circuit and to detect possible faults thereof. To do this, the control unit 125 may be configured (i.e. programmed) to perform a check sequence of the heating circuit for detecting possible failures of the components thereof.

The control unit 125 periodically senses the line voltage value via the voltage partition network 245, 246 (e.g., every 20-80 milliseconds).

Figure 3:
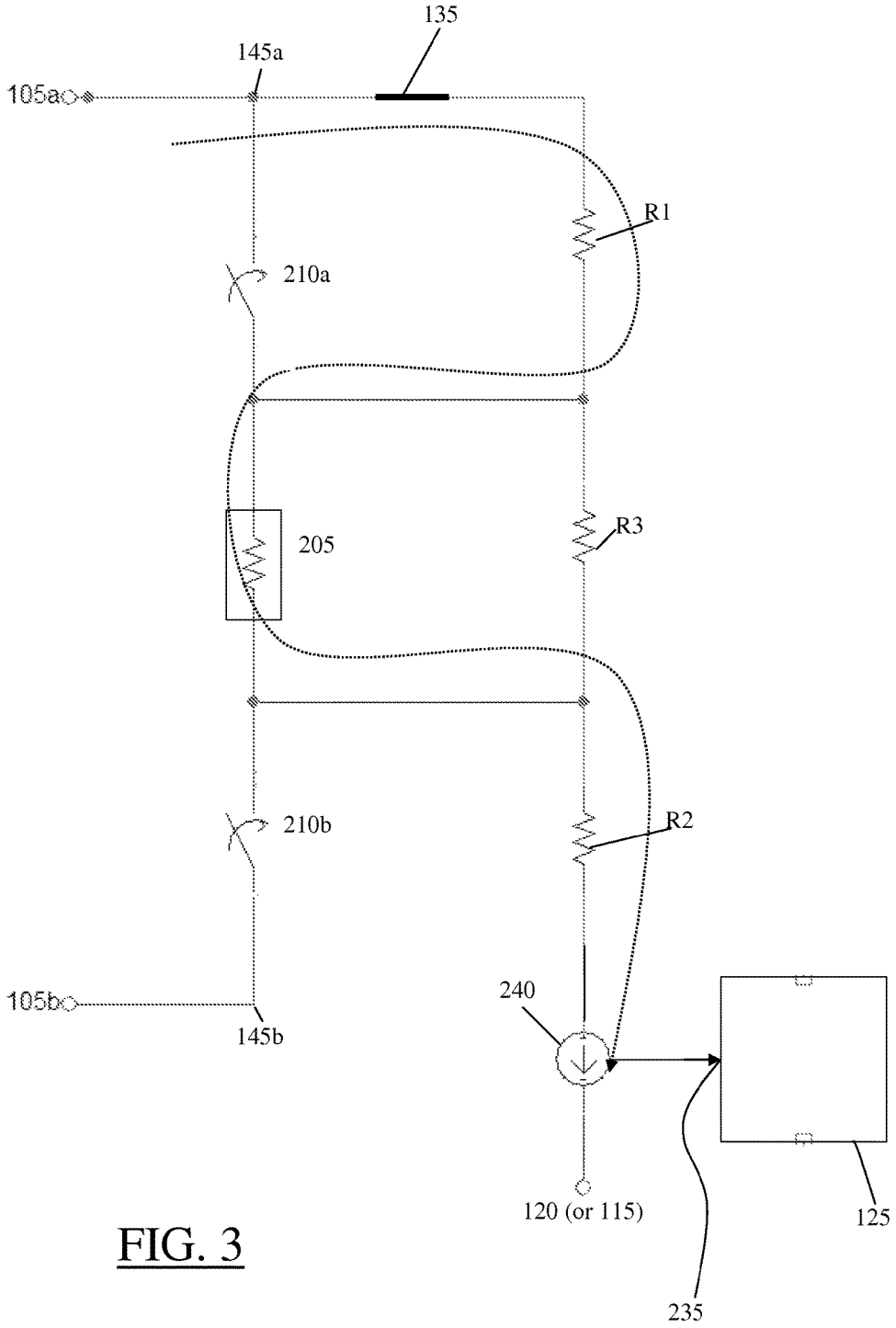
FIGS. 3-6 schematically show current paths in different operating conditions of the heating circuit arrangement of FIG. 2.

From the sensed value of the line voltage, the control unit 125 can calculate a reference value for the current flowing through the resistive network; the reference current value $I_0$ is calculated for an operating condition in which the main switch 135 is closed, the switches 210*a* and 210*b* are both open, and no the heating circuit exhibits no faults (see FIG. 3), as follows:

$$I_0=V_{145a}/(R1+R2)$$

where $V_{145a}$ is the voltage at terminal 145*a*, which is related to the sensed line voltage, R1 is the resistance value of the first resistor R1 and R2 is the resistance value of the second resistor R2 (the resistance of the heating resistor 205 is negligible, and thus also the resistance of the shunt of the heating resistor 205 and the third resistor R3 is negligible).

The calculated reference current value $I_0$ is used to set a working point, and thresholds useful for detecting the presence of possible faults.

Figure 4:
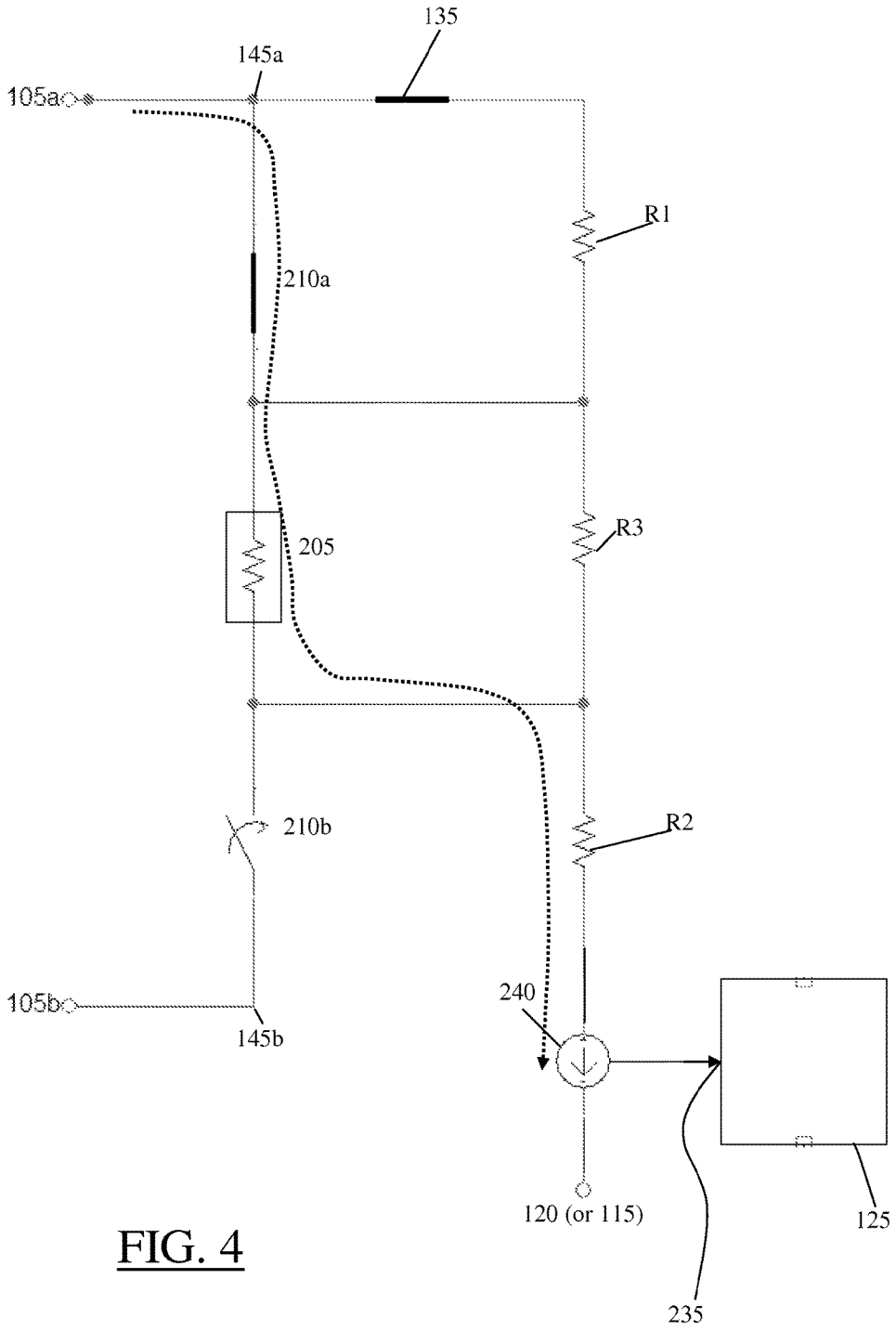
Figure 5:
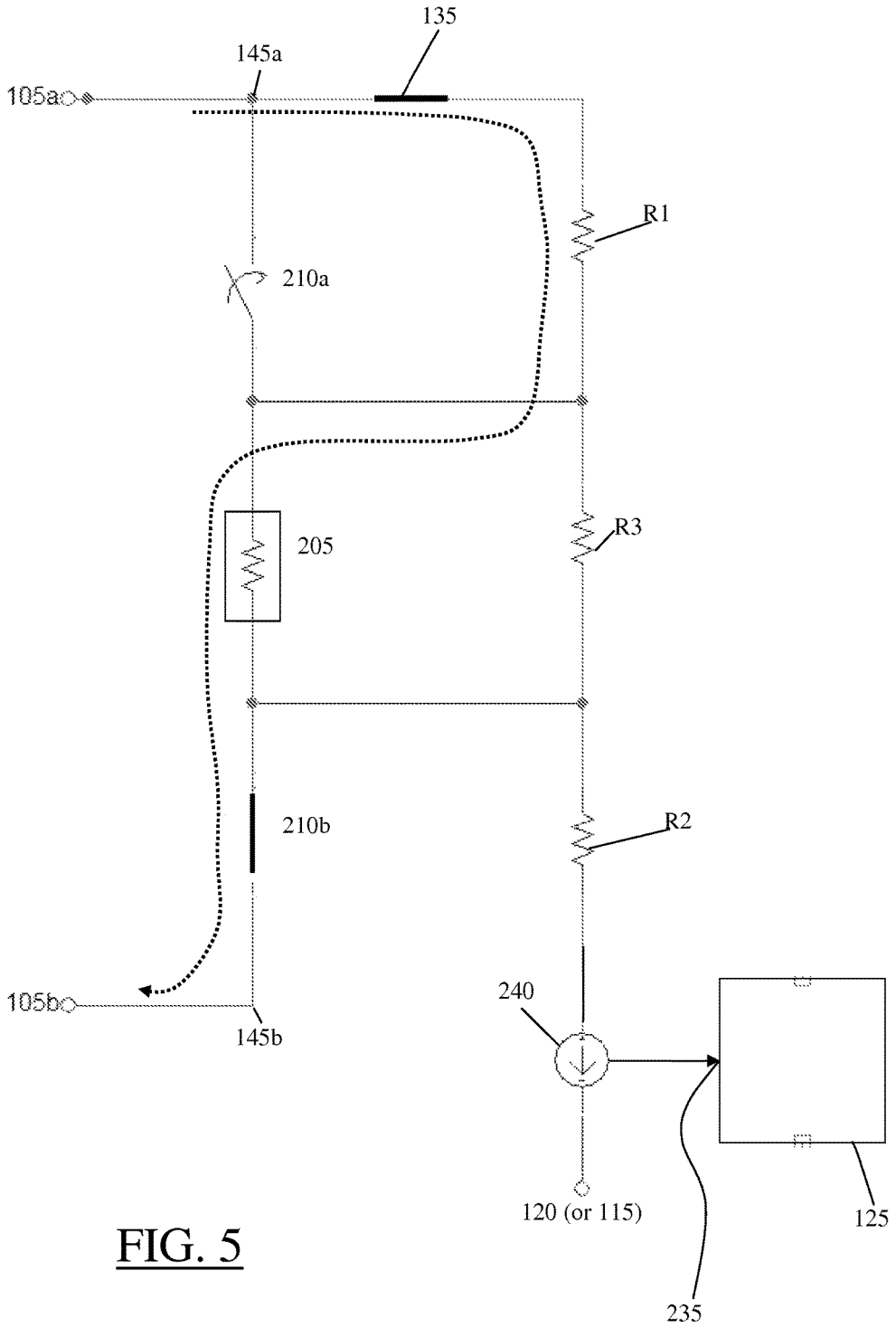

For example, if the control unit 125 commands the two switches 210*a* and 210*b* to be open, and the current measured by the current sensor 240 is substantially higher than the reference current /ø, the control unit 125 is able to determine that the switch 210*a* is blocked closed ("glued closed"), or that the output of the control unit 125 that drives the switch 210*a* is faulty and not able to command the switch 210*a* to open. In fact, as shown in FIG. 4, when the switch 210*a* is closed, the first resistor R1 is bypassed, so that the overall resistance of the resistive network is less than expected, and the current passing through the current sensor 240 is higher and approximately equal to $V_{145a}$/R2 (almost all of the current passes through the heating resistor 205, since the resistance thereof is much lower than that of the third resistor R3). If instead the current measured by the current sensor 240 is essentially zero, the control unit 125 can determine that there is a problem in connection with the switch 210*b* (switch glued closed or faulty driving output of the control unit 125). In fact, as shown in FIG. 5, when the switch 210*b* is closed, the current sensor 240 is bypassed.

Figure 6:
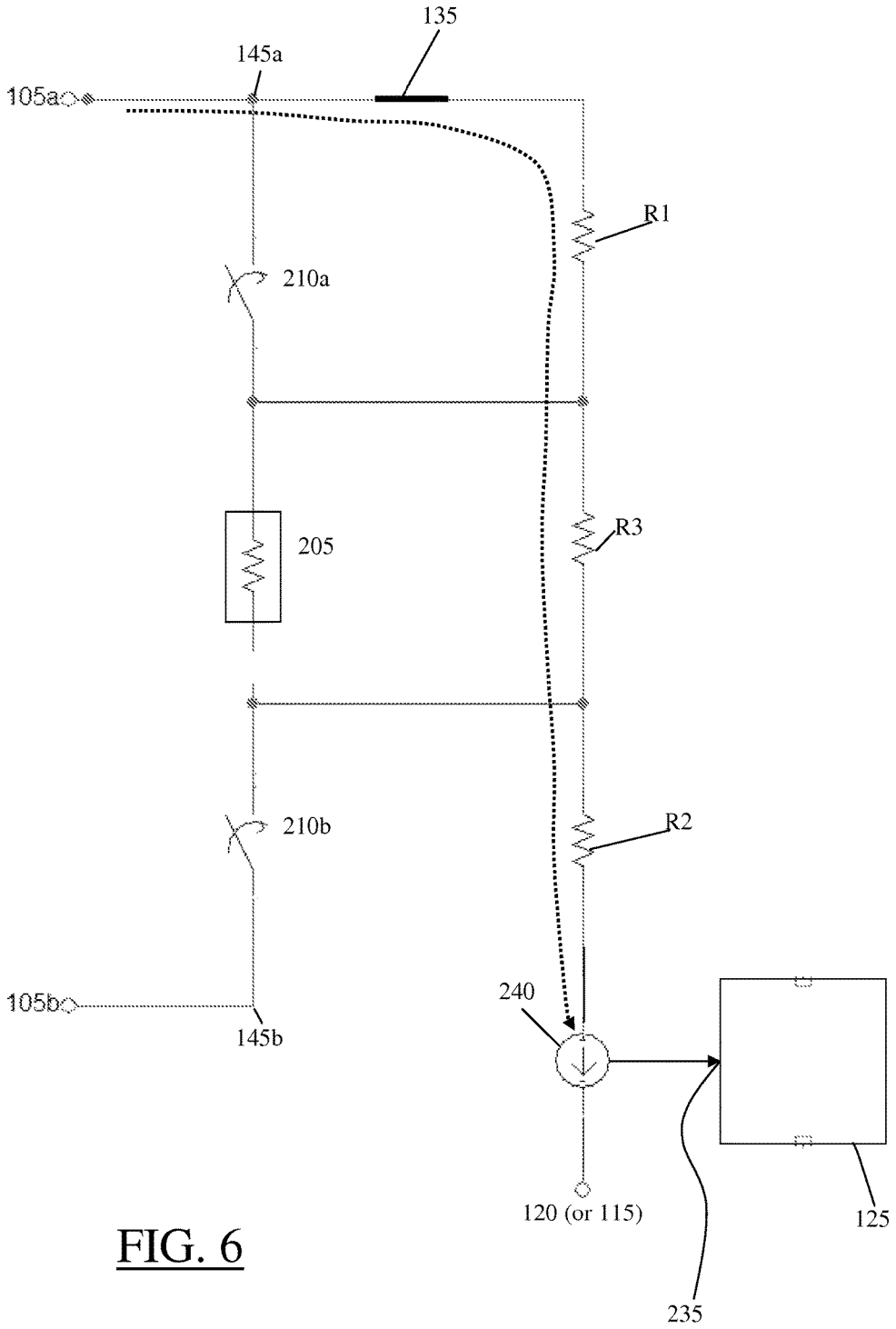

If the current measured by the current sensor 240 is less than the reference current $I_0$, and approximately equal to:

$$V_{145a}/(R1+R2+R3)$$

where R3 is the resistance of the third resistor R3, the control unit 125 is able to detect that the heater resistor 205 is open (i.e., non-conductive); in fact, as shown in FIG. 6, in this condition no current flows through the heating resistor 205, and the current flows instead through the third resistor 220. It can be appreciated that the provision of the third resistor R3 enables discriminating this type of fault compared to "switch 210*b* glued closed" fault (indeed, without the third resistance R3, the current flowing through the current sensor 240 would be zero, like in the "switch 210*b* glued closed" fault).

A fault of the heating resistor 205 causing a current leakage towards earth (terminal 145*b*) or towards the line voltage (terminal 145*a*) corresponds to the introduction of an additional resistor in parallel to the second resistor R2 or to the first resistor R1, which alters the value of the current flowing through the current sensor 240 (the circuit configuration allows discriminating leakage faults corresponding to resistance values towards earth or line voltage of the order of a hundred of KOhms).

When the control unit 125 commands the main switch 135 to open (with the switches 210*a* and 210*b* kept open as well), the current through the resistive network should be zero, so that a different current value may be detected as a fault.

If, for the practical implementation of the current sensor 240, a resistor is used, as mentioned in the foregoing, from the sensed value of the line voltage, the control unit 125 can dynamically calculate and periodically update (e.g., every 20-80 milliseconds) threshold values being dimensionless quantities which are calculated using a mathematical function implemented by the control unit 125. Similarly, the control unit 125 derives, from the voltage resulting from the current sensing operated by the current sensor 240 and received at the measuring input 235, a dimensionless quantity that is compared to the dimensionless threshold values calculated on the basis of the detected line voltage. Based on the outcome of the comparison, the control unit 125 is capable of detecting faults in the heating circuit arrangement. It is pointed out that the threshold values change as the line voltage changes: thanks to this, account is taken of the actual value of the line voltage, which as known may differ from country to country, and is also subject to fluctuations in time around the nominal value. This makes the detection of the possible fault conditions more accurate and reliable.

FIG. 7 schematically shows a heating circuit according to another embodiment of the present invention. The difference compared to the heating circuit of FIG. 2 is that the first resistor R1 of the resistive network is connected between the voltage line downstream the main switch 135 and the terminal 215*b* of the heating resistor 205 connected to the switch 210*b*, and the second resistor R2 is connected to the terminal 215*a* of the heating resistor 205. The operation of the circuit is essentially similar to that of FIG. 2; FIG. 8 shows the current path in case of no faults when the main switch 135 is closed and the two switches 210*a* and 210*b* are open (the condition used to calculate the reference current).

The table below (Table 1), which refers to the circuit of FIG. 7, provides an indication of how the voltage sensed at the measuring input 235, and thus the dimensionless value calculated by the control unit 125, changes depending on the status of the heating circuit arrangement and in case of different fault conditions. The values in Table 1 shown underlined are indicative of fault conditions.

TABLE 1

| Door lock | Switch 210a | Switch 210b | Sensed value | | | | | |
|---|---|---|---|---|---|---|---|---|
| open | open | open | 0 | 0 | 0 | 0 | 0 | 202 |
| closed | open | open | 170 | <150 | <170 | 3 | <170 | 202 |
| closed | open | closed | 3 | 0 | <170 | 3 | 3 | 202 |
| closed | closed | closed | 202 | 202 | 202 | 202 | 3 | 202 |
| | | | No faults | heating resistor open | Switch 210b glued open OR fault of driving circuit | Switch 210b glued close | Switch 210a glued open or fault in driving circuit | Switch 210a glued close |

When the control unit 125 commands the main switch 135 and the other two switches 210*a* and 210*b* to be in the open condition (first row of Table 1), the voltage developing across the fourth resistor R4 and sensed by the control unit 125 at the measuring input 235 should (in case of no faults) be low, close to earth (in this condition, no current flows through the resistive network, and therefore no voltage develops across the fourth resistor R4; in Table 1, the dimensionless value corresponding to an absence of faults is 0. A detected high value (corresponding to the value of the line voltage) of the voltage at the measuring input 235 (and thus a high value of the dimensionless value derived therefrom) is thus indicative of the fact that the switch 210*a* does not operate properly and is blocked closed ("glued closed"); in this condition, the overall resistance of the resistive network is lower than expected (because the first resistor R1 is bypassed) and the current flowing through the current sensor 240 is rather high, so that a relatively high voltage develops across the fourth resistor R4.

When the control unit 125 commands the main switch 135 to close, but keeping the other two switches 210*a* and 210*b* open, so as to keep the heating resistor 205 de-energized (second row in Table 1), the voltage sensed at the input 235 should, in case of no faults, correspond to the reference current Io (FIG. 8). In Table 1, the dimensionless value corresponding to no faults is 170. As shown in Table 1, based on the value of the voltage sensed at the input 235, the control unit 125 is capable of detecting and discriminating three possible faults:

a) a relatively high value (150 or less in Table 1), but sufficiently lower than the value (170) corresponding to the no-fault condition is indicative of the fact that the heating resistor 205 is "open", i.e. non-conductive; in fact, in this case the resistance value of the shunt connection between the heating resistor 205 and the third resistor R3 essentially coincides with the resistance of the third resistor R3, which is substantially higher than the resistance of the heating resistor 205. This type of fault may depend on a malfunctioning of one or both of the thermofuses which may be provided at the terminals of the heating resistor 205, or a problem with the heating resistor 205.

b) a very low value (3 in Table 1), close to ground, is indicative of the fact that the switch 210*b* is blocked closed ("glued closed"); in fact, in this condition the terminal 215*b* is short-circuited to the neutral, and thus the current sensor 240 is bypassed.

c) a high value, corresponding to the line voltage (202 in Table 1) is indicative of the fact that the switch 210*a* is blocked closed ("glued closed"); in fact, in this condition the terminal 215*a* is short-circuited to the line voltage and the first resistor R1 is bypassed.

When the control unit 125 commands the main switch 135 to close, the switch 210*a* to open and the switch 210*b* to close (third row in Table 1), a no-fault condition corresponds to a very low value sensed at the input 235 (corresponding to the dimensionless value 3 in Table 1); indeed, in this condition the terminal 215*b* is short-circuited to the neutral, and thus the voltage at the terminal 215*a* is low. As shown in Table 1, based on the value of the voltage sensed at the input 235, the control unit 125 is capable of detecting and discriminating two possible faults:

d) a first high value (170 or less as indicated in Table 1) means that the switch 210*b* is "glued open" (this faulty condition corresponds to the condition in FIG. 8), or that there is a fault in the driving output of the control unit that drives the switch 210*b*.

e) a second high value, higher than the first high value and corresponding to the line voltage (202 in Table 1) is indicative of the fact that the switch 210*a* is blocked close ("glued close"); in fact, in this condition the terminal 215*a* is short-circuited to the line voltage.

When, finally, the control unit 125 commands all the switches 135, 210*a* and 210*b* to close (fourth row in Table 1), a no-fault condition corresponds to a high voltage value sensed at the input 235; in fact, in this condition the terminal 225*a* should be short-circuit to the line voltage. A very low value (close to ground) is in this case indicative of the fact that the switch 210*a* is "glued open" (or that there is a fault in the driving output of the control unit 125 that drives the switch 210*a*). In fact, in this condition the terminal 215*b* is short-circuit to the neutral, and thus the voltage at the terminal 215*a* is low.

The provision of the two switches 210*a* and 210*b* in the heating circuit 140, one upstream and the other downstream the heating resistor 205, makes the heating circuit 140 safer: also in case of faults in the heating resistor, by switching open the two switches 210*a* and 210*b* the appliance can be put in conditions of safety for the user without having to open the door, and possibly without having to halt the machine operation.

In particular, the heating circuit described allows to discriminate whether a fault consists in the heating resistor being disconnected or in current leakages in the heating resistor; the first fault is not dangerous for the user's safety: it simply means that the washing liquid (or the drying air flow) cannot be heated; the second fault is instead potentially dangerous, because of dispersion currents. In both cases, the machine cycle needs not be halted: the control unit 125 commands the two switches 210*a* and 210*b* to open and leaves the appliance to terminate the cycle.

Thus, thanks to the circuit arrangement according to the described embodiment, it is possible to detect not only a failure of the heating resistor 205 consisting in a short-circuit to the neutral, but also to detect if a failure involving the heating resistor is risky or acceptable.

An advantage of the described solution is that the heating circuit, inclusive the elements necessary to properly monitor the heating circuit for possible faults, substantially does not involve stand-by power consumption. In fact, when the appliance is not operating, the main switch 135 and the two switches 210*a* and 210*b* are open, thus no conductive path exists between the line voltage and the neutral (also the resistive path including resistors R1, R3 in parallel to 205, R2 and R4 is disconnected from the line voltage); the only consumption is given by the resistive partition network 245, 246. However, nothing prevents from connecting the resistive network (i.e., the first resistor R1) upstream the main switch 135, or, viceversa, connecting the heating circuit (heating resistor 205 and switches 210*a* and 210*b*) downstream the main switch 135 and the monitoring resistive network upstream, or moving all circuit 140 downstream the main switch 135.

Clearly, those skilled in the art will be able to make several changes to the described invention embodiment, without departing from the scope of the invention defined in the appended claims. For example, the current sensor 240 may be implemented in any known way, for example as an amperometric transformer or a Hall sensor, etc.

The invention claimed is:

1. A washing and/or drying appliance, comprising a heating circuit for heating a washing liquid and/or a drying air flow, the heating circuit being connected to voltage distribution lines distributing power inside the appliance and comprising at least one heating resistor, a first switch, and a second switch, wherein:

the first switch and the second switch are controlled by an appliance control unit for selectively energizing the heating resistor;

the heating resistor is interposed between the first and second switches with a first node on a high side of said heating resistor in electrical contact with a low side terminal of said first switch, and a second node on a low side of said heating resistor being in electrical contact with a high side terminal of said second switch;

a monitoring circuit arrangement is associated with the heating circuit, said monitoring circuit arrangement comprising a resistive network including a first resistor connected to a first terminal of the heating resistor of the heating circuit so as to be bypassed when the first switch is closed, and a second resistor connected to a second terminal, different from the first terminal, of the heating resistor of the heating circuit so as to be bypassed when the second switch is closed, the monitoring circuit arrangement further comprising a current sensor arranged to measure a current flowing through the resistive network and to feed an indication of the measured current to the control unit;

the control unit is configured for assessing possible faults of the heating circuit based on the indication of the measured current; and the first resistor has a first terminal coupled to a first one of the voltage distribution lines and a second terminal connected to the first terminal of the heating resistor which is coupled to said first one of the voltage distribution lines, and the second resistor has a first terminal connected to the second terminal of the heating resistor opposite the first terminal of the heating resistor and a second terminal coupled to a second one of the voltage distribution lines.

2. The appliance of claim 1, further comprising a main switch controlled by the control unit for selectively allowing the powering of the appliance, wherein the heating circuit is connected to the voltage distribution lines upstream or downstream of the main switch with respect to an AC voltage plug of the appliance.

3. The appliance of claim 2, wherein said main switch is switchable to close only on a condition that the control unit detects that an appliance door is closed.

4. The appliance of claim 2, wherein said resistive network of the monitoring circuit arrangement is connected to the voltage distribution lines either downstream or upstream of the main switch.

5. The appliance of claim 1, wherein the resistive network further comprises a third resistor connected in shunt to the heating resistor and having a resistance value substantially higher than the heating resistor resistance value.

6. The appliance of claim 1, wherein said current sensor comprises a resistor in series to the first and/or second resistors.

7. The appliance of claim 1, wherein said current sensor comprises one among an amperometric transformer or a Hall sensor.

8. A washing and/or drying appliance, comprising a heating circuit for heating a washing liquid and/or a drying air flow, the heating circuit being connected to voltage distribution lines distributing power inside the appliance and comprising at least one heating resistor, a first switch, and a second switch, wherein:

the first switch and the second switch are controlled by an appliance control unit for selectively energizing the heating resistor;

the heading resistor is interposed between the first and second switches with a first node on a high side of said heating resistor in electrical contact with a low side terminal of said first switch, and a second node on a low side of said heating, resistor being in electrical contact with a high side terminal of said second switch;

a monitoring circuit arrangement is associated with the heating circuit, said monitoring circuit arrangement comprising a resistive network including a first resistor connected to a second terminal of the heating resistor of the heating circuit so as to be bypassed when the first switch is closed, and a second resistor connected to a first terminal, different from the second terminal, of the heating resistor of the heating circuit so as to be bypassed when the second switch is closed, the monitoring circuit arrangement further comprising a current sensor arranged to measure a current flowing through the resistive network and to feed an indication of the measured current to the control unit;

the control unit is configured for assessing possible faults of the heating circuit based on the indication of the measured current; and the first resistor has a first terminal coupled to a first one of the voltage distribution lines and a second terminal connected to the second terminal of the heating resistor which is coupled to a second one of the voltage distribution lines, and the second resistor has a first terminal connected to the first terminal of the heating resistor which is coupled to the first one of the voltage distribution lines and a second terminal coupled to the second one of the voltage distribution line.

9. The appliance of claim 3, wherein said resistive network of the monitoring circuit arrangement is connected to the voltage distribution lines either downstream or upstream of the main switch.

10. The appliance of claim 2, wherein the resistive network further comprises a third resistor connected in shunt to the heating resistor and having a resistance value substantially higher than the heating resistor resistance value.

11. The appliance of claim 3, wherein the resistive network further comprises a third resistor connected in shunt to the heating resistor and having a resistance value substantially higher than the heating resistor resistance value.

12. The appliance of claim 4, wherein the resistive network further comprises a third resistor connected in shunt to the heating resistor and having a resistance value substantially higher than the heating resistor resistance value.

13. The appliance of claim 2, wherein said current sensor comprises a resistor in series to the first and/or second resistors.

14. The appliance of claim 3, wherein said current sensor comprises a resistor in series to the first and/or second resistors.

15. The appliance of claim 4, wherein said current sensor comprises a resistor in series to the first and/or second resistors.

16. The appliance of claim 5, wherein said current sensor comprises a resistor in series to the first and/or second resistors.

17. The appliance of claim 2, wherein the first resistor has a first terminal coupled to a first one of the voltage distribution lines and a second terminal connected to the first terminal of the heating resistor which is coupled to said first one of the voltage distribution lines, and the second resistor has a first terminal connected to the second terminal of the heating resistor opposite the first terminal of the heating resistor and a second terminal coupled to a second one of the voltage distribution lines.

18. The appliance of claim 5, wherein the first resistor has a first terminal coupled to a first one of the voltage distribution lines and a second terminal connected to the first terminal of the heating resistor which is coupled to said first one of the voltage distribution lines, and the second resistor has a first terminal connected to the second terminal of the heating resistor opposite the first terminal of the heating resistor and a second terminal coupled to a second one of the voltage distribution lines.

19. The appliance of claim 8, further comprising a main switch controlled by the control unit for selectively allowing the powering of the appliance, wherein the heating circuit is connected to the voltage distribution lines upstream or downstream of the main switch with respect to an AC voltage plug of the appliance.

* * * * *